US005839203A

United States Patent [19]

Orloff et al.

[11] Patent Number: 5,839,203

[45] Date of Patent: Nov. 24, 1998

[54] IMPULSE DRYER

[75] Inventors: David I. Orloff; Timothy Patterson; Isaak Rudman, all of Atlanta, Ga.

[73] Assignee: Institute of Paper Science and Technology, Inc., Atlanta, Ga.

[21] Appl. No.: 794,900

[22] Filed: Feb. 5, 1997

Related U.S. Application Data

[60] Division of Ser. No. 618,294, Mar. 18, 1996, Pat. No. 5,669,159, which is a continuation-in-part of Ser. No. 440, 539, May 12, 1995, Pat. No. 5,598,642.

[51] Int. Cl.[6] ..... F26B 19/00

[52] U.S. Cl. ..... 34/71; 34/120; 34/624

[58] Field of Search ..... 34/558, 71, 94, 34/95, 110, 111, 112, 114, 118, 120, 126, 620, 624, 625, 626; 100/83, 86, 88, 93 RP; 162/206, 207, 358.1, 359.1

[56] References Cited

U.S. PATENT DOCUMENTS

| | | | |
|---|---|---|---|
| 2,784,652 | 3/1957 | Hornbostel | 34/111 |
| 3,799,052 | 3/1974 | Küsters et al. | 34/118 X |
| 3,938,261 | 2/1976 | Anderson | 34/114 |
| 5,071,513 | 12/1991 | Bluhm et al. | 34/111 X |
| 5,101,574 | 4/1992 | Orloff et al. | 34/18 |
| 5,291,666 | 3/1994 | Babinsky et al. | 34/18 |
| 5,327,661 | 7/1994 | Orloff | 34/388 |
| 5,404,654 | 4/1995 | Babinsky et al. | 34/122 |
| 5,439,559 | 8/1995 | Crouse | 162/358.5 |
| 5,649,371 | 7/1997 | Loser et al. | 34/111 |

*Primary Examiner*—Henry A. Bennett
*Assistant Examiner*—Steve Gravini
*Attorney, Agent, or Firm*—Fitch, Even, Tabin & Flannery

[57] ABSTRACT

A method and apparatus for drying a fiber web is provided by pressing the web, preferably by impulse drying and then introducing the web into a gas pressurized zone followed by reducing the pressure in the zone, the reduction preferably being effected with cooling of the fiber web.

6 Claims, 9 Drawing Sheets

IMPULSE DRYER

CROSS REFERENCE TO RELATED APPLICATIONS

This application is a division of application Ser. No. 08/618,294 filed Mar. 18, 1996 U.S. Pat. No. 5,669,159, which in turn is a continuation-in-part of commonly owned U.S. patent application Ser. No. 08/440,539, filed May 12, 1995 U.S. Pat. No. 5,598,642.

BACKGROUND OF THE INVENTION

1. Field of the Invention

The present invention relates generally to a method and apparatus for drying a wet fiber web using a pressing operation in which one surface of the press is heated to a high temperature. The apparatus provides the capability to expose the web to ambient pressures above atmospheric and increasing cooling rates when the press load is released. The press may be a linear motion press, a roll press, or a shoe press. The web may be a single sheet or a continuous web. More particularly, the invention relates to impulse drying of a wet paper web.

2. Description of the Related Art

Impulse drying occurs when a wet paper web, carried on a water absorbing felt, passes through the press nip of a pair of rolls, or a roll and shoe, in which a roll is heated to a high temperature. Impulse drying may also be accomplished using a linear press with flat platens, in this case one platen is heated and the other may be at ambient temperature. It is projected that wide commercialization of impulse drying would result in a large industry wide energy savings.

In addition to the impact on energy consumption, impulse drying also has an impact on paper sheet structure and properties. Surface fiber conformability and interfiber bonding are enhanced by transient contact with the hot pressing surface. Impulse drying produces a distinctive density profile through the sheet that is characterized by a dense outer layer. This translates into improved physical properties for many grades of paper. One persistent problem with the use of impulse drying is that as the press load is released, the pressure exerted on the heated fluid inside the web is reduced and flash evaporation can occur inside the web. The result is that the web delaminates. This is particularly a problem with heavy weight grades of paper. It has been a major constraint in the commercialization of impulse drying.

It has been reported (in Crouse, et al. "Delamination: A Stumbling Block to Implementation of Impulse Drying Technology for Liner Board", TAPPI Engineering Conference, Atlanta, Ga., September 1989), that various degrees of delamination were experienced with liner board dried at press roll surface temperatures above 150° C. (300° F.). When delamination was avoided by operating at temperatures below 150° C. (300° F.), water removal efficiencies were not significantly different than those obtained by conventional pressing. It was concluded in this paper that to realize the potential of impulse drying it would be necessary to alleviate delamination.

In laboratory scale simulations (Laverly, H. P., "High Intensity Drying Process—Impulse Drying Report Three" DOE/CE/40738-T3, February, 1988), it was found that increased pulp refining encouraged delamination and it was postulated that thick or highly refined sheets exhibit greater resistance to the flow of vapor than thin or unrefined paper webs. Thick and refined paper webs have a high specific surface and therefore a high flow resistance. When the press load is released, high vapor pressures are produced internal to the web because the vapor cannot readily escape the web. If the pressure is high enough, the web structure fails and the web delaminates. Reducing the temperature of the press surface eliminates delamination, but also reduces water removal to the point that the impulse drying process is no more efficient than standard double felted pressing.

Orloff, D. I., in "Impulse Drying Control of Delamination" and in U.S. Pat. No. 5,101,574 shows that reducing the thermal diffusivity of the heated press surface reduces the probability that delamination will occur. Thermal diffusivity is given as $K/\rho C_V$ where K is the thermal conductivity, $\rho$ is the density and $C_V$ is the specific heat. The magnitude of this quantity determines the rate at which a body with a non-uniform temperature approaches equilibrium. The units of thermal diffusivity, after cancelling like terms, are meter$^2$ per second ($m^2/s$).

It is also noted by Orloff that the press surface must be impermeable to steam since, if a porous material is used to reduce the thermal diffusivity of the press surface, the characteristic density profile of impulse drying is not produced. Orloff shows that a non-permeable, low thermal diffusivity press surface allows higher press surface temperatures to be used for some furnishes, as compared to a high thermal diffusivity surface. A typical high thermal diffusivity surface is steel. A low thermal diffusivity surface can be produced using ceramics, polymers, inorganic plastics, composite materials and cermets. At the higher press surface temperatures made possible by a low thermal diffusivity surface, the water removal efficiency of impulse drying exceeds that of double felted pressing. However, low thermal diffusivity press surface will produce web delamination if the heated press surface is at too high a temperature.

SUMMARY OF THE INVENTION

It is the principal object of the present invention to provide a method and apparatus for heated surface pressing and impulse drying which inhibits web delamination at heated press surface temperatures ranging from the ambient boiling temperature of the internal web liquid to temperatures in excess of the critical point temperature of the internal web liquid. The method and apparatus are effective at inhibiting web delamination regardless of press surface thermal diffusivity, web internal structure, web basis weight, or web internal liquid.

DETAILED DESCRIPTION OF THE PREFERRED EMBODIMENT

Figure 1:
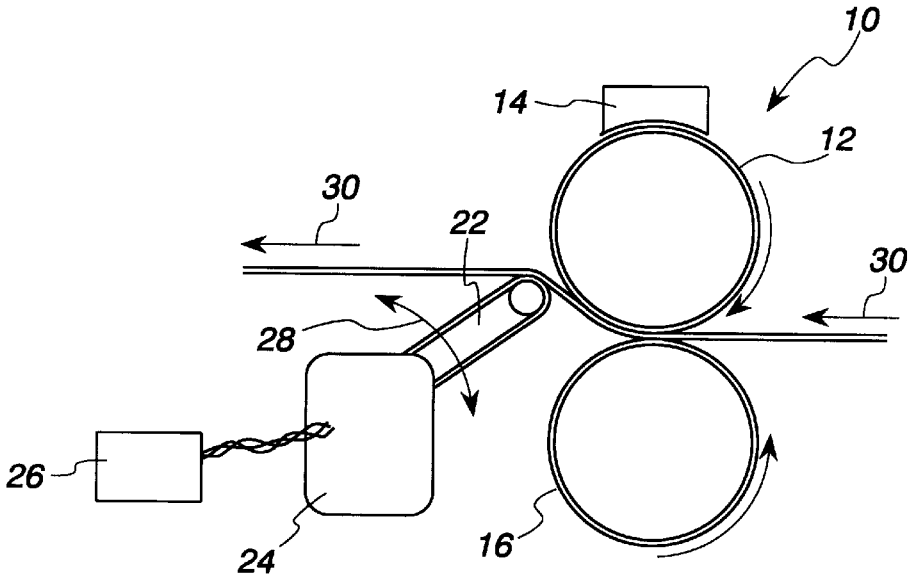
FIG. 1 is a schematic side view of a roller press that is designed to perform heated press surface pressing at elevated pressures.

The present invention is directed generally to a method and apparatus for drying a wet fiber web or sheet using a heated surface press and an important application is impulse drying. The present invention can employ a wide range of commercial apparatus, including a linear motion press, a roll nip press, a shoe press, or a wide nip press. The present invention provides heated press surface pressing at elevated pressures, which are released with a relatively shallow slope decompression curve.

The shallow slope decompression can be accomplished using a variety of different techniques. For example, when a roll press is employed, the web exiting the nip formed between the press rolls is wrapped an appropriate amount about the surface of the heated roll to provide a final stage of pressurization for the treated web.

Alternatively, the web exiting the nip between the rollers can be subjected to a region of elevated gas pressure and/or an increased cooling rate which coincides with the region the sheet or web occupies when the press load on the web or sheet is released. The elevated gas pressure need only be a fraction of the pressure corresponding to the thermodynamic saturation pressure of the liquid inside the web when the liquid is at a temperature equal to the heated press surface temperature. The pressurizing gas may be air or other suitably inert gas which does not react in an undesirable manner with the web, vapor or apparatus. The gas may be cooled or serve to cool below ambient temperatures. The method inhibits web delamination regardless of press surface thermal diffusivity, web internal structure, web basis weight, or web internal liquid.

The details of the apparatus vary to accommodate the press used. One preferred embodiment of the apparatus includes: apparatus for drying a fiber web comprising, in combination, pressing means for said web, including a heated roll and another roll, together forming a nip through which the web passes, the apparatus further comprising web wrapping means for wrapping the web exiting the nip between the rollers, about the heated roll, so as to prolong pressure on the web for a time period at least between one to two times as great as the time period during which the web is pressed in the nip between the rolls.

Another preferred embodiment includes: apparatus for drying a fiber web comprising, in combination, pressing means for said web, a gas pressure chamber adjacent said pressing means, means for introducing pressurized gas into said pressure chamber, means for controlling gas pressure in said gas pressure chamber so as to prolong pressure on the web for a time period at least between one to two times as great as the time period during which the web is pressed in the nip between the rolls, and means for venting gas from said gas pressure chamber. In the case of a linear press, the chamber may enclose the entire press. In the case of a roll press, the chamber may enclose either the entire press or only the exit area in the region of the press nip.

The present invention is directed to the discovery that web delamination can be eliminated, regardless of press surface thermal diffusivity, web specific surface, web basis weight, or web internal liquid, by providing a prolonged, gradually tapering decompression as the press load on the web is released. Different press arrangements, including rotary and non-rotating presses such as linear motion presses and shoe presses, can be provided for achieving the prolonged, gradually tapering decompression which prevents delamination over a wide range of commercially important platen or roller press temperatures.

The concluding portion of the decompression cycle, preferably that exhibiting a shallow decompression slope, may be obtained in a number of different ways. For example, the web may be partially wrapped about a heated press roll to prolong the application of pressure to a web exiting the press roll nip. Alternatively, the web exiting the press roll nip may be commercially made to enter a pressurized environment.

There is an ongoing effort to understand the mechanisms for controlling the vapor generated forces within the web. It is believed that these mechanisms include, but are not limited to, some reduction in the mass of liquid which flashes to vapor, increased cooling of the web or sheet, reduced exhaust velocity of vapor, reduction in vapor induced drag forces, prevention of sonic vapor velocity across constrictions in internal web pores and reduction in static force imbalances. These mechanisms can be enhanced by releasing pressure on the web in a multiple step manner in which the concluding step is prolonged with respect to preceding steps, and in which the concluding step has a shallow slope operating characteristic.

As mentioned, the concluding shallow slope decompression step is preferably accomplished without requiring use of pressurized gas at the exit of the press rolls. However, as will be seen later herein, decompression can also be concluded with the use of a pressurized gas which is introduced to a pressure chamber, preferably at a temperature below the ambient temperature. A gas at ambient pressure or which is heated to a temperature above the ambient temperature may also be used, however the gas pressure required to inhibit delamination may need to be increased. The pressurizing gas may be air or another suitable gas which does not react in an undesirable manner with the web, vapor or apparatus.

EXAMPLE 1

Advances made possible by the present invention are preferably attained with partial wrap methods in an industrial scale apparatus, such as that schematically indicated in FIG. 1. The operation of this apparatus will be explained with additional reference to FIGS. 2–5. Apparatus in FIG.1 includes a roll press generally indicated at 10. The roll press 10 includes a heated roll 12, a heater 14 associated with roll 12 and a lower unheated roll 16. A web 18 passing through a nip 20 formed between rolls 12, 16 is comprised of two layers of material, with the upper layer including a fiber web to be dried, overlaid on top of a similarly sized felt web used to transport the fiber web. An arm 22 is driven by an operator 24 under control of a computer 26. Web 18 is moved in a downstream direction indicated by arrows 30, using conventional drive mechanism (not shown). As indicated by arrow 28 in FIG. 1, arm 22 is movable in opposite directions and is positioned so as to contact web 18 in a way which alters its path of travel. The portion of web 18 shown in FIG. 1 has a generally S-shaped configuration, with arm 22 being raised in contact with web 18 so that the downstream portion (i.e. downstream of nip 20) is at a higher elevation than the upstream portion of the web. This, in effect, causes the downstream portion of web 18 to wrap about a portion of heated roll 12 immediately after exiting nip 20. By raising and lowering arm 22, the amount of wrap of the web about the heated roll can be varied.

The performance of drying of the web was carefully studied, particularly with respect to the effects on the web of impulse drying for varying amounts of wrap about the heated roll 12. As will be seen with reference to FIGS. 2–5 herein, the heater 14 is operated so as to maintain the temperature of roll 12 at different desired values, representative of conventional industrial operating conditions. Delamination of the web was noted for certain heated roll temperatures and wrap conditions.

The use of wrap arms and certain control systems therefor are generally known in the paper industry. Wrap arms have been employed with heated rolls to treat paper webs. However, the effect of the wrap arm control has generally speaking been viewed with regard to overall or long term effects on the paper web observed at a downstream location. In contrast, the emphasis here has been to study the thermodynamic effects and other effects on the web immediately after its exit from the nip formed between the press rolls. As would be expected, pressure on web 18 approaches a maximum value at the nip, usually regarded as a line of contact between the press rolls exerted on the web which travels in a direction generally a tangent to the roll surfaces at their line of contact. As the web exits the roll press, pressure on the web is reduced to a point associated with the ambient environment.

Figure 2:
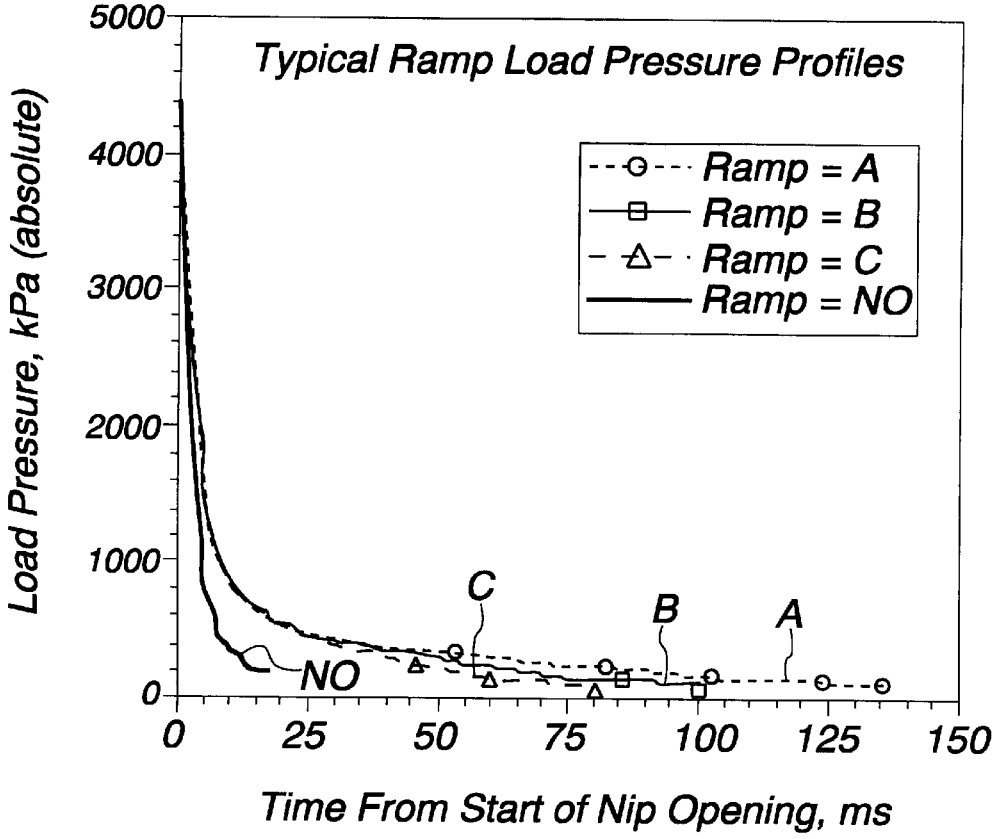
FIG. 2 is a plot of load pressure profiles associated with pressing operation.

Particular attention has been paid to the manner in which pressure experienced by the web drops after exiting the roll press nip. In a practical commercial environment, the compression of the fiber web occurs very rapidly, generally over times less than one quarter of a second. As will be seen herein, a number of practical implementations of the present invention have been carried out within the first one quarter second after the web exits the press roll nip. Referring now to FIG. 2, pressure on the web within the first two tenths of a second after exiting the press roll nip was observed for various operating conditions. The operations graphically indicated in FIGS. 2–4 were performed on paper hand sheets having 65% moisture, specific surface of 25 $m^2/g$, Canadian Standard Freeness (CSF) of 400 ml, and a basis weight of 204 $g/m^2$ (42 lb/1000 $ft^2$). A series of pressing tests were conducted where the device in FIG. 1 was used to impulse dry the sheets at platen set point temperatures indicated in FIGS. 3 and 4, ranging generally between 200° and 260° C. The pressing residence time was approximately 40 milliseconds and the maximum platen pressure was about 4.4 MPa.

As can be seen in FIG. 2, four pressing tests were conducted, with operating curves labeled A, B, C, and NO. The operating curves shown in FIG. 2 begin generally at a point in time where pressure exerted on the web has reached a maximum and has begun a reduction toward surrounding ambient values.

Referring to FIG. 2, curve NO indicates pressure experienced by the web without the effect of wrap arm 2, i.e. with the path of web travel being along a generally straight line upstream and downstream of the press rolls and generally tangent to the line contact between the press rolls. Compared to the remaining curves shown in FIG. 2, curve NO has the shortest duration, lasting for approximately 20 milliseconds. The remaining curves shown in FIG. 2 are associated with varying amounts of wrap of the web about the heated roll 12 with the amount of wrap increasing from curve C to curve B, and with curve A showing the greatest amount of wrap of the web about the heated roll. As can be seen in FIG. 2, the tests were concerned with modification of the decompression profile of the web immediately upon exiting the press roll nip. In these tests, the ambient pressure surrounding the impulse dryer was maintained at 1 atmosphere (101 kPa absolute) while the post nip pressure profile was modified by adding a shallow slope ramp profile. As will be seen herein, the ramp profile extension may be achieved in a number of different ways, but is preferably implemented by operation of the post impulse drying roll wrap associated with operation of arm 22.

Using the hand sheets identified above, all conditions were maintained constant in the four impulse drying tests, except that the post nip decompression profile and the platen (i.e. heated roll 12) set-point temperature were modified. In FIG. 2 it can be seen that curve NO has an initial generally straight line portion (i.e. minimal curvature) between time zero and approximately 5 ms. Curve NO then takes on a continuously curved portion between times 5 ms and 20 ms, with the curve terminating at 20 ms at ambient pressure of 101 kPa. In general, the greatest pressure drop associated with curve NO takes place along the initial straight line portion, where pressure drops from an initial value of 4400 kPa to a value of approximately 800 kPa. As mentioned, curve NO is carried out with no wrap of the web about either press roll. Accordingly, applied pressure to the web is free to drop in an unrestrained manner after the web exits the nip between the press rolls. In contrast, curves A, B and C involve the application of pressure to the web after the web exits the nip between the press rolls, thus prolonging application of pressure to the web. As can be seen in FIG. 2, the four curves of the test begin with approximately the same initial value and the initial straight line or minimal curvature portions are of somewhat comparable lengths. As can be seen in FIG. 2, curves A, B and C have initial straight line, minimal curvature extending between initial pressure values of 4400 kPa to a value of approximately 1200 kPa, generally one-fourth the initial, starting value. The transition from straight line or minimal curvature operation to a continuously curved transition operation occurs at approximately 7 ms. With reference to curve A, continuous curved operation continues until time approximately 25 ms where operation is concluded with a final straight line or minimal curvature portion having a "shallow" or gradually tapering slope, substantially shallower slope than preceding portions of the decompression operation and extending over a substantial amount of time compared to the duration of the preceding decompression operations. For example, curve A is a first operation of approximately 7 ms duration, a transition operation between approximately 7 ms and approximately 27 ms. In contrast, the concluding generally straight-line with minimal curvature portion extends between 27 ms and approximately 135 ms. In general, it is preferred that the ending time period is at least between two to eight times longer than the first portion of the operating curve and that the pressure reduced over the first portion of the operating curve is at least between two to eight times greater than the pressure reduced over the final portion of the operating curve.

Referring again to FIG. 2, curves B and C are of increasingly shorter duration than curve A but also exhibit the same shallow slowly changing operating curve. Even for the shorter operating curves B and C, the time duration of their concluding operating portion, that exhibiting the characteristic shallow slope, is still several times, at least two to eight times, longer than the initial period of operation which herein lasts approximately the first seven milliseconds after web pressure falls below a maximum value.

Figure 3:
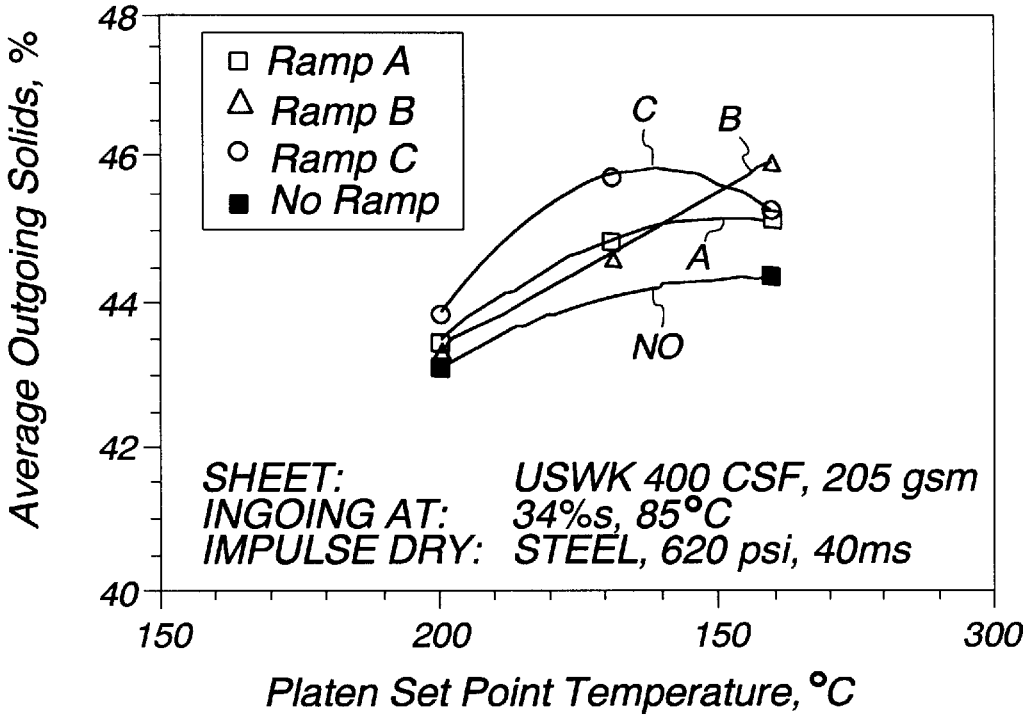
FIG. 3 is a plot of average outgoing solids as a function of platen set point temperatures, associated with the load pressure profiles of FIG. 2.

With reference to FIG. 3, an increase in outgoing solids was observed with increased platen set-point temperature. The increase in outgoing solids is associated with an increase in post nip decompression duration which is made to occur over a small time period, less than one-quarter second).

Figure 4:
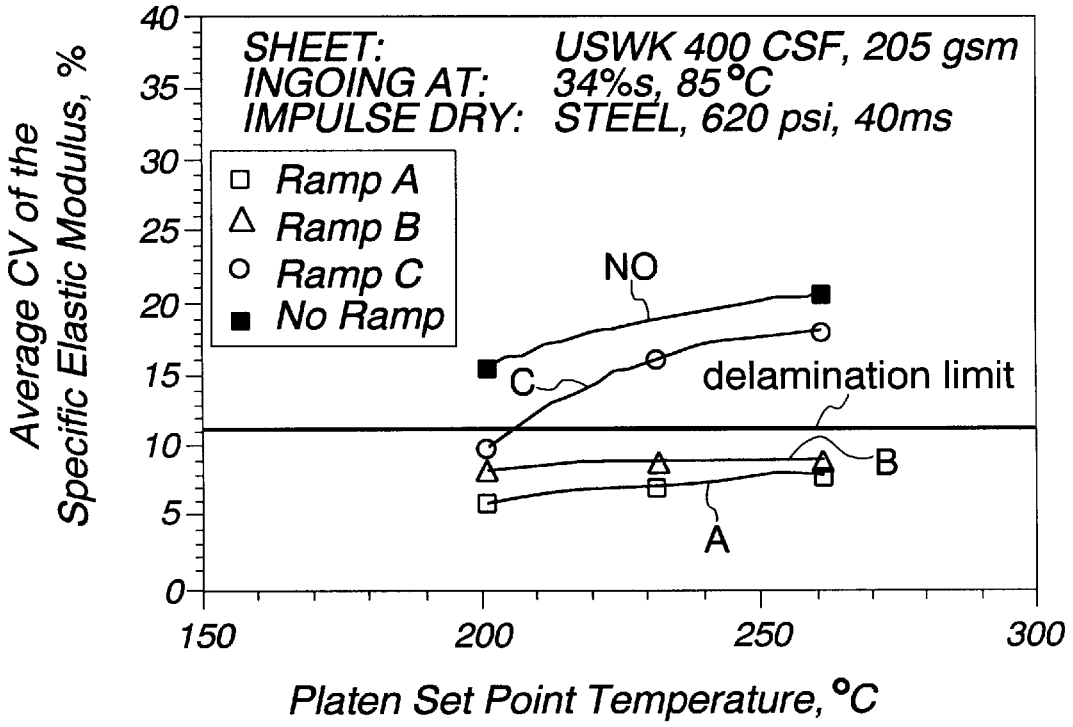
FIG. 4 is a plot of average Coefficient Variation of the specific elastic as a function of set point temperature, corresponding to load pressure profiles of FIG. 2.

Referring to FIG. 4, the coefficient of variation of the specific elastic modulus was determined using out-of-plane ultrasound techniques of conventional nature. A plot of these values with respect to platen set-point temperature is shown in FIG. 4, corresponding to the ramp profiles of FIG. 2. Sheets in which delamination has been observed were found to have Coefficients of Variation in excess of between 10 and 15%. A delamination limit of approximately 12% is shown in FIG. 4. In FIG. 4 lower values of Coefficients of Variation are associated with more desirable product characteristics. As indicated in FIG. 4, sheets dried using the NO ramp exhibited delamination at all platen set-point temperatures investigated. As can be seen in FIG. 4, ramp C was effective in preventing delamination of only a portion of its operating curve, generally corresponding to platen set-point temperatures less than 200° C. However, decompression profiles A and B (as shown in FIG. 2) were effective in preventing delamination at all platen set-point temperatures.

Figure 5:
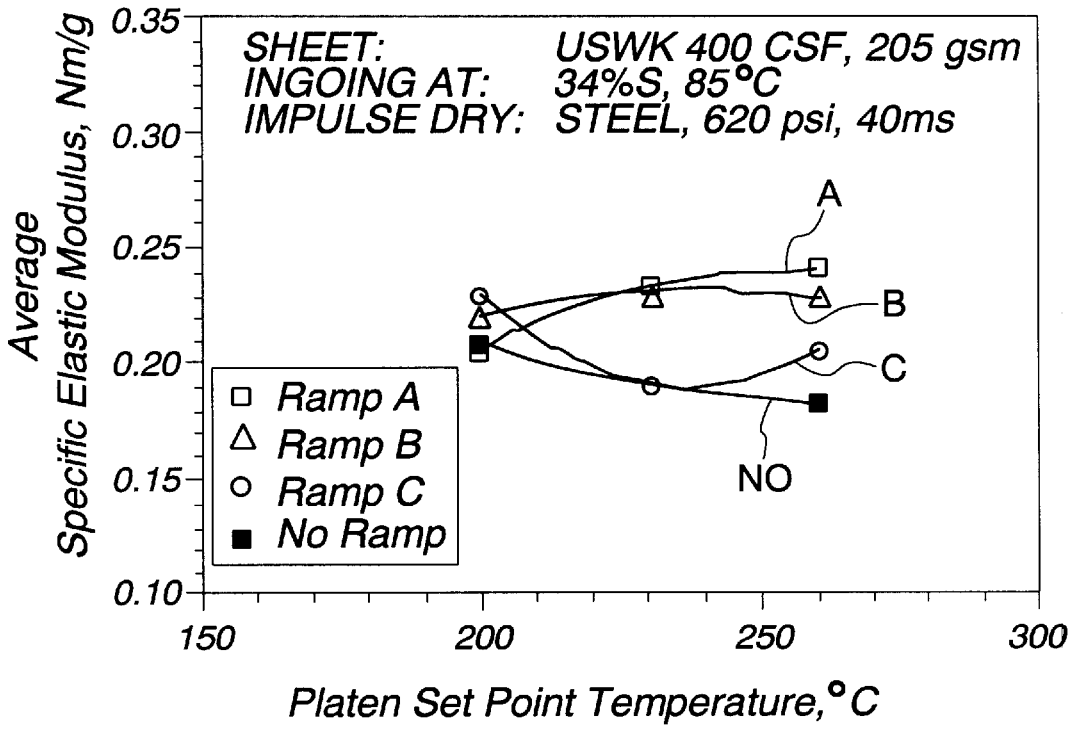
FIG. 5 is a plot of average specific elastic modulus as a function of platen sub-point temperature, corresponding to the load pressure profiles of FIG. 2.

FIG. 5 shows an increase in specific elastic modulus with increased platen set-point temperature for sheets produced using the conversion operating curves A and B in FIG. 2. As can be seen in FIG. 5, curves NO and C have generally lower values of average specific elastic modulus and further have an opposite direction of curvature compared to operating curves A and B.

As can be seen herein, the present invention is effective in reducing the probability of delamination by modifying the post-nip decompression process. Based upon theoretical considerations using thermodynamic principles, it is believed that the reduced probability of delamination is associated with a reduction in the extent of internal expansion of the web exiting the press roll nip, a lengthening of the time during which flashed a vapor can escape from the web, and a reduction of the forces exerted on the web which lead to delamination.

EXAMPLES 2–7

The post nip extended decompression period was achieved in the arrangement of FIG. 1 using wrap around control. However, other arrangements are possible. For example, extended decompression can also be achieved using a pressurized gas in the area immediately downstream of the nip opening 20. Various arrangements employing a pressurized gas will be described herein. However, in general, the apparatus includes: a chamber for containing the pressurizing gas or the equivalent, means of introducing the pressurizing gas, means of monitoring the pressure of the pressurizing gas, means of controlling the pressure of the pressurized gas, means of venting the pressurizing gas, means of introducing the sheet or web to the press, and means of removing the sheet or web from the pressurized chamber.

The magnitude of the gas pressure required to prevent delamination is dependent on the liquid internal to the web, the amount of liquid internal to the web, the web internal structure, the web basis weight, and the thermal diffusivity of the heated press surface. However, it is possible in all cases to exert a gas pressure which inhibits delamination of the web. The elevated gas pressure need only be a fraction of the pressure corresponding to the thermodynamic saturation pressure of the liquid inside the web when the liquid is at a temperature equal to the heated press surface temperature. The purpose is not to inhibit flashing, but rather to control the forces exerted on the web structure by the vapor either resident in the web or generated in the web as the press load is released.

The chamber for containing the pressurized gas need only maintain the required pressure to inhibit delamination in the immediate vicinity of the web or sheet. The region encompassed by the chamber must include that region occupied by the web or sheet when the press load is released. If desired, the chamber may include the entire press. The chamber region must be large enough that the web or sheet is maintained in the pressurized region for a sufficient time to inhibit delamination. This time will vary with web structure, web basis weight, web internal fluid and heated press surface temperature. In the case of a typical paper web containing water this time is less than 2 seconds and in many commercially important conditions is less than 200 ms.

The chamber need not incorporate a sealed physical structure. In a particular application it may be sufficient to create the effect of a chamber by use of gas jets to create a pressurized region of the required size. If the chamber uses a physical structure to contain the gas, the chamber may leak gas, provided the pressure in the region of the web is maintained and the leaking gas does not damage the apparatus, web or constitute a safety hazard. The leaking of the gas may cause a cooling effect.

The apparatus must have means of introducing the pressurizing gas to the pressure chamber. The method used for introducing the gas should not result in a jet is of gas impacting on the web or sheet surface with sufficient force to cause damage. If the pressure required to inhibit delamination of the web is high enough that such a jet is produced, then the jet must either be oriented so it does not damage the web or sheet or a baffle mechanism must be introduced between the web and the gas jet. The method used for introducing the gas to the chamber should incorporate means of adjusting the flow of gas into the chamber.

The apparatus should include means of monitoring the pressure of the pressurizing gas inside the chamber. The method used is dependent on the application. In a batch type process, a simple industrial type gauge may be sufficient. In a continuous process, a pressure transducer providing a continuous output to a control system may be required. The means employed must only provide an indication of the pressure in the chamber sufficient for controlling that pressure. The accuracy and speed of the measurement is that required to inhibit delamination and for efficient operation of the apparatus. Efficient operation is dependent on the application.

The apparatus comprises a means of venting the pressurized gas. The method used should not cause damage to the web. The method used for venting the gas should incorporate means of controlling the rate at which the gas is vented.

The apparatus has means of introducing the sheet or web to the press. The method employed need only ensure that the pressure within the chamber is maintained when the press load is released. In the case of a roll press, a felt may be used to introduce the web to the press. In the case of a linear press, the web or sheet may be introduced manually or by using a mechanical device.

The apparatus further comprises means of removing the sheet or web from the press and pressure chamber. The method used need only ensure that the web or sheet remains pressurized to some extent, over a prolonged period as pressure levels are reduced, so as to inhibit delamination. In the case of a continuous operation, the chamber pressure is maintained. Effective cooling by the gas is desired. In the case of a roll press, a felt can be used to transport the web or sheet from the press nip through the pressure chamber. The felt also acts as a water receiver. The chamber may have a slot opening through which passes the felt and the web. The opening is sealed in such a way that the web is able to pass through and that any gas leakage is limited to that which can be compensated for by the method employed for introducing gas to the chamber. The seal may incorporate a flexible wiper or pair of rolls which are in contact with the web or sheet. In the case of a linear press, the web or sheet can be removed manually or by using a mechanical device.

In the most preferred alternative method of the present invention, the web or sheet is introduced into a heated surface press having opposed surfaces. The heated surface is of a rigid material which can be easily heated, such as steel or steel coated with a material having specific thermal or material properties, i.e., ceramics, polymers, inorganic plastics, composite materials and cermets or any other material with the required strength properties. Thus, the heated surface may have high or low diffusivity. The other surface may either be a rigid material with the strength properties required for the particular press load and application, such as steel, or it may be steel coated with a polymer, or the belt of a shoe press. In one embodiment, a web of a resilient material, such as a felt, is interposed between the unheated surface and the heated surface as the web is introduced to the press. The two press surfaces are urged together to provide a compressive force on the web. In the case of impulse drying of paper, the preferred compressive nip pressure is from about 0.3 MPa to about 10.0 MPa.

The heated surface is heated to provide a surface temperature between the atmospheric boiling temperature of the internal web fluid and the thermodynamic critical point temperature of the internal web fluid. In the case of a paper web containing water, the temperature is from about 100° C. to about 374° C., preferably from about 200° C. to about 300° C.

The residence time in the press and the pressurized region beyond is adjusted to provide maximum fluid removal. In the case of a paper web, the residence times can be from about 10 ms to 1000 ms, preferably from about 20 ms to about 60 ms. In a roll press or shoe press, the residence time is controlled by the speed of the web and the length of the press nip.

The method of the present invention is useful for drying paper webs having an initial moisture level of from about 75% to about 50%. The moisture content of the paper web after being subjected to impulse drying in accordance with the invention will be in the range of from about 65% to about 30%. All percentages used herein are by weight, unless otherwise specified. The gas pressure required to inhibit delamination depends on the paper furnish, basis weight and press heated surface temperature. In general, the minimum gage pressure required is about 0.00 MPa (0.00 psig) and the maximum gage pressure required is about 0.70 MPa (100 psig) with a heated press surface temperature of 250° C. These pressures may be reduced by employing a cooled gas to pressurize the chamber into which the web is received after the press load is released. The cooled gas will further reduce the mass of liquid which flashes to vapor, increase cooling of the web or sheet, reduce exhaust velocity of vapor, reduce vapor induced drag forces, prevent sonic vapor velocity across constrictions in internal web pores and reduce static force imbalances. The gas may be used to cool through its flow or expansion.

Figure 6:
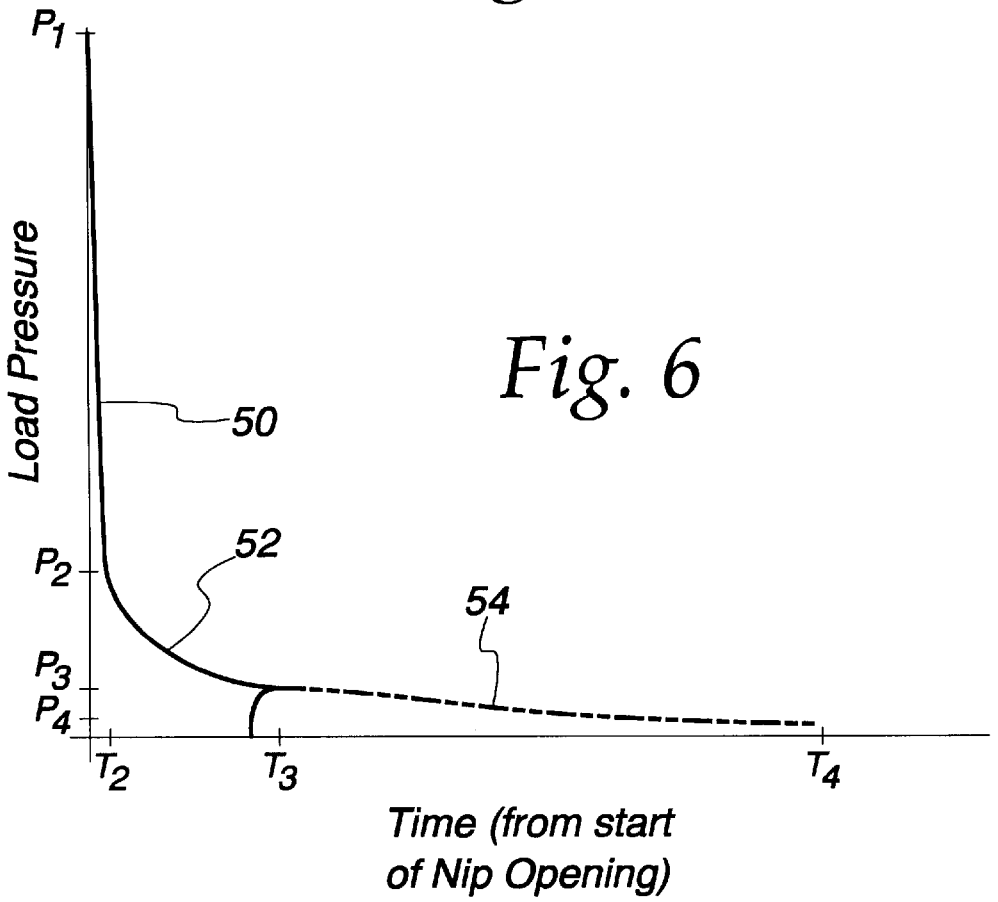
FIG. 6 is a plot of low pressure as a function of time showing decompression of a treated web according to an alternative arrangement wherein the web exiting the rollers is passed into a region of elevated gas pressure.

Referring now to FIG. 6, characteristic operation in a hybrid decompression mode is shown. FIG. 6 shows a typical operating curve indicating decompression of a typical web using hybrid techniques for applying pressure to the web to effect impulse drying under commercial important operating conditions, yet without delamination. It will be seen that the curve of FIG. 6 is similar to the operating curves shown in FIG. 2. As with the decompression curves previously examined, the operating curve shown in FIG. 6 is comprised of three portions, an initial portion 50 which is generally straight-line or minimal curvature in nature, a continuously curved intermediate portion 52 and a concluding portion 54 also of minimal curvature, herein referred to as a generally straight-line portion. The first portion of the decompression curve of FIG. 6 occurs between time equals zero and $T_2$, during which pressure drops from an initial value $P_1$ to $P_2$. The transition portion of the operating curve extends between times $T_2$ and $T_3$, wherein pressure is dropped from a value $P_2$ to a value $P_3$. Finally, the concluding portion 54 of the operating curve extends between times $T_3$ and $T_4$ during which pressure is dropped an additional amount, from value $P_3$ to value $P_4$. In the embodiment indicated in FIG. 6, the initial and transition pressure drops (curved portions 50 and 52, respectively) brought about by mechanical means, wherein the wall and the web pass unabated beyond the nip formed between the press rollers, similar to the operating condition NO described with reference to FIG. 2. However, steps are taken to achieve the operating curve of FIG. 6 by applying a concluding pressure to the web thus extending or prolonging decompression on the web, as indicated by curved portion 54. Curved portion 54 is preferably achieved by applying a gaseous pressure to the web immediately after the web exits the nip between the press rolls, i.e. in a manner such that the operating curve indicated in FIG. 6 is substantially continuous. It will be noted that the rise of gas pressure experienced by the web need not be instantaneous and a typical relatively brief rise time is indicated in FIG. 6 by the short time interval occurring immediately before time $T_3$. In the preferred embodiments to follow, it is generally preferred that the curve of FIG. 6 be used to approximate operating curves illustrated above in FIG. 2 so as to enjoy the advances in the art associated with results indicated in the operating curves of FIG. 2. However, it will be recognized by those skilled in the art that other pressure values and time values, and plots of operating conditions having curvatures differing from those illustrated in FIG. 2 can be employed to practice the present invention. It is, however, generally preferred that the ending time period (i.e. between times $T_3$ and $T_4$) be at least two to eight times longer than the initial time period (ending at time $T_2$). Further, it is generally preferred that the initial pressure $P_1$ be at least two to eight times greater than $P_2$, the pressure value at the end of the initial portion of the operating curve, where the greatest amount of pressure reduction takes place. It is also preferred that the pressure reduced over the first time period (curve portion 50) be at least two to eight times greater than the pressure reduced over the final time period (i.e. with reference to curve portion 54). Further, it is generally preferred that the initial and final operating curve portions (i.e. curved portions 50 and 54) have significantly less curvature than the transition portion 52 and accordingly curved portions 50 and 54 are referred to as being generally linear. Various examples of practical methods for implementing the operating conditions illustrated in FIG. 6 will now be given.

EXAMPLE 2

Figure 14:
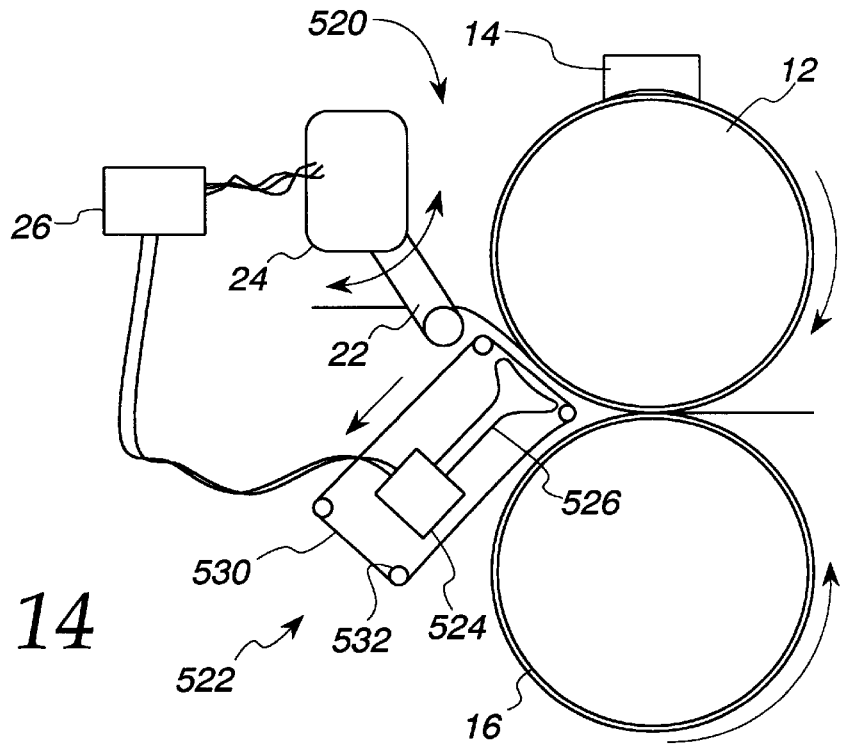
FIG. 14 is a fragmentary schematic side view of an alternative roller press illustrating features of the present invention.
Figure 15:
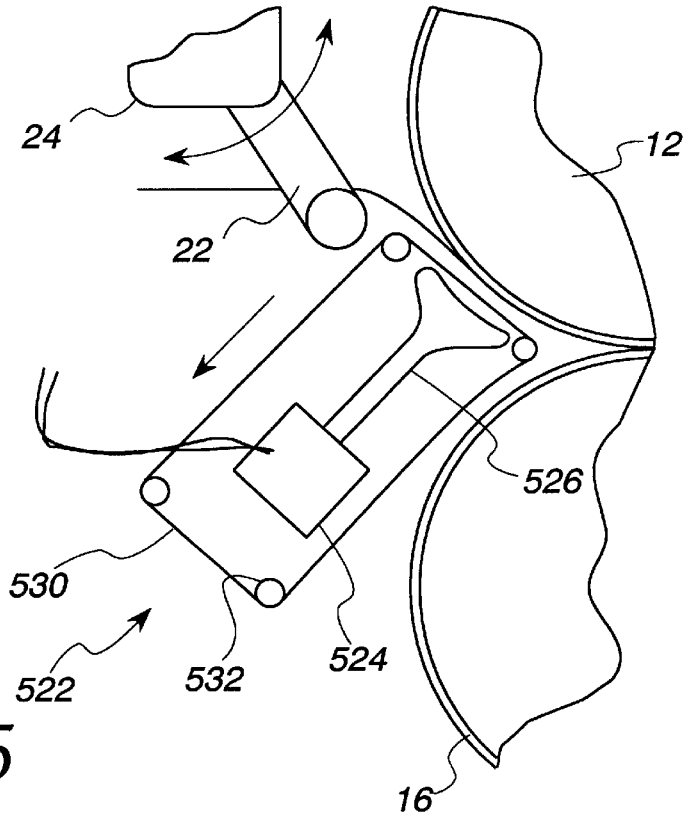
FIG. 15 is an enlarged fragmentary view thereof.

Turning now to FIGS. 14 and 15, roller press apparatus is generally indicated at 520. The roller press 520 is generally identical to the roller press arrangement 10 illustrated in FIG. 1, but with the addition of a high pressure shoe arrangement generally indicated at 522. Included in the shoe arrangement 522 is an air cylinder 524 which urges a shoe 526 toward and away from roller 12. A belt 530 supported by rollers 532 travels in a closed path about shoe 526. As illustrated in FIG. 15, a portion of the belt 530 is located between shoe 526 and the web. When cylinder 524 is operated, shoe 526 presses the belt 530 against the web, thereby pressing the web against the outer surface of roller 12, so as to augment the effect of lever arm 22 on the web. It is preferred that the operating cylinder 524 be controlled by computer 26 so that the overall pressure experienced by the web after it exits the roller nip can be better controlled, and so that the relative balance between the lever arm 22 and the shoe assembly 522 can be maintained at a desired ratio. Further, if desired, the lever arm could be retracted with the shoe assembly 522 alone providing the post-nip pressure on the web. Further, any of the pressurized gas arrangements, such as a gas manifold 506 in FIG. 16, can be employed in conjunction with the shoe arrangement 522, although this has not been found to be necessary.

EXAMPLE 3

Figure 16:
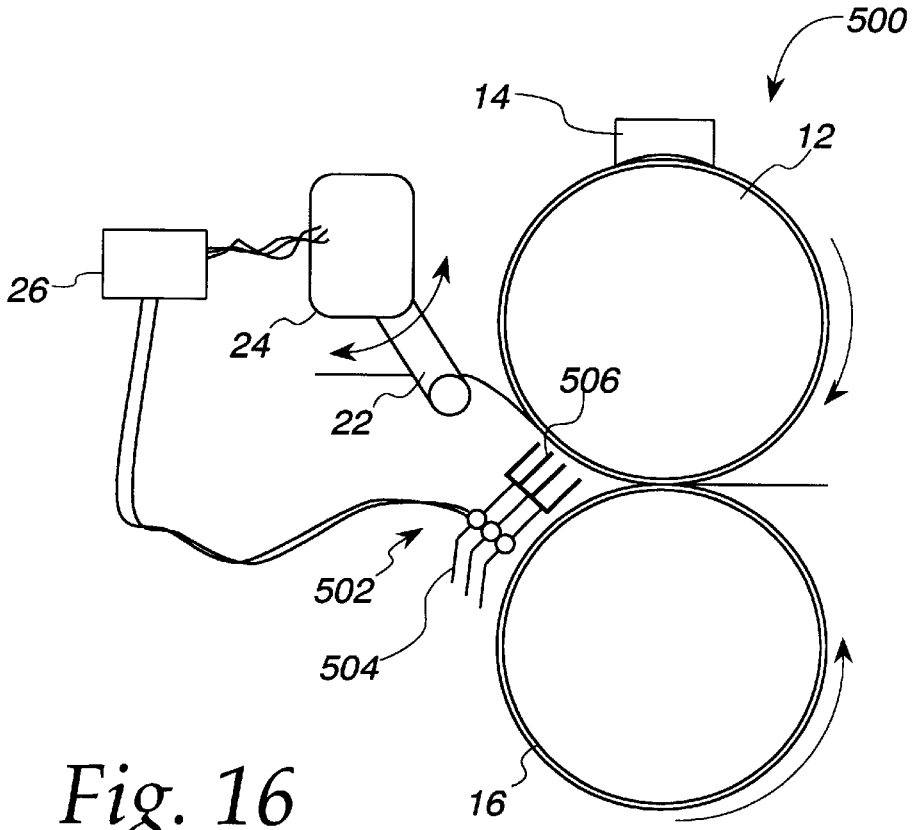
FIG. 16 is a fragmentary schematic side view of another alternative roller press illustrating features of the present invention.
Figure 17:
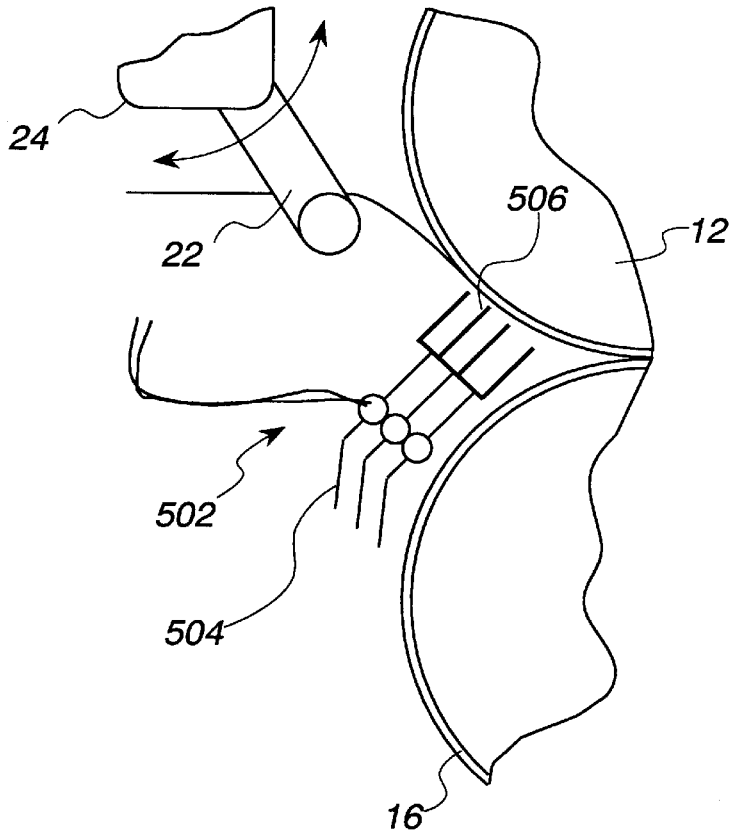
FIG. 17 is an enlarged fragmentary view thereof.

Turning now to FIGS. 16 and 17, a roll press generally indicated at 500 is illustrated, having two different modes or types of post-nip decompression arrangements. Roll press 500 is substantially identical to the roll press 10 described above, but with the addition of a high pressure air manifold assembly generally indicated at 502 in which a plurality of air lines 504 are employed to discharge high pressure gas through nozzle arrangement 506 against the web. As mentioned, the present invention has found immediate application in drying fibrous webs of paper composition, backed by a supporting felt web. Preferably, air is used as the pressurized gas, but other gas compositions could also be employed. As indicated in FIG. 16, it is preferred that the pressurized gas be directed to the side of the web at which the supporting felt is located. The lever arm 22, as explained above, imparts a tension to that side of the web containing the supporting felt. It is preferred that the pressure released through the nozzle arrangement 506 is placed under control of computer 26 so that the cumulative effects on the web can be controlled, along with the proportional balancing of the effects of the lever arm 22 and the air manifold 506.

EXAMPLE 4

Figure 8:
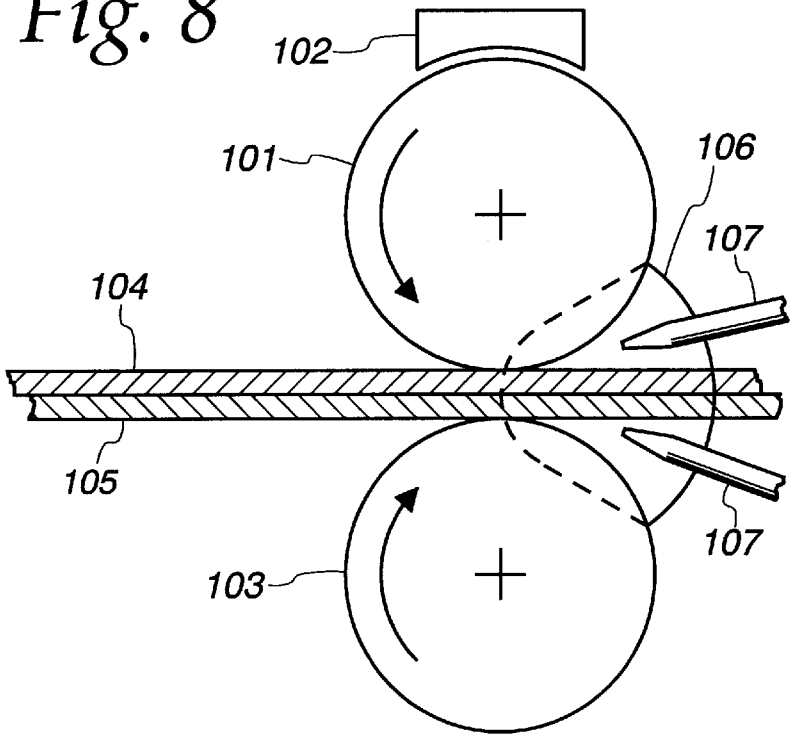
FIG. 8 is a schematic side view of the apparatus shown in FIG. 6 taken along line 8—8.
Figure 7:
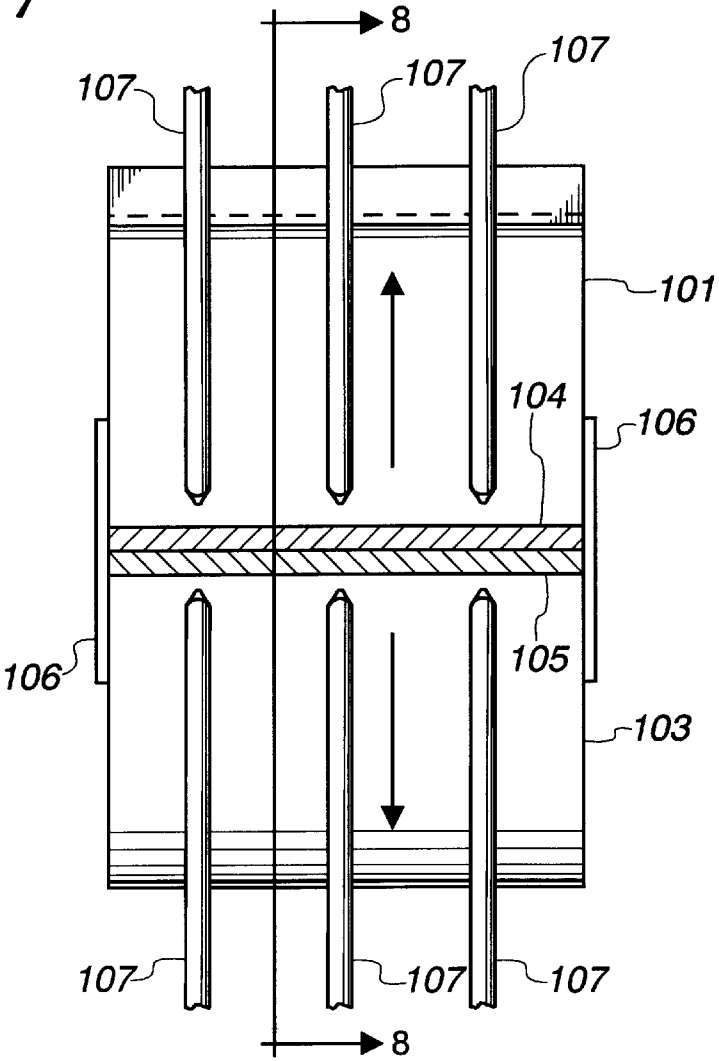
FIG. 7 is a schematic end view of another industrial implementation of the invention.

The method of the present invention can be implemented on an industrial scale as shown in FIGS. 7 and 8. The apparatus in FIGS. 7 and 7 is a roll press. It includes a heated roll 101, a heater 102, a lower unheated roll 103, the web 104 being pressed between the rolls on a felt 105 used for transporting the web 104, a pair of side covers 106 and a number of air knives 107. The heated roll 101 and the lower roll 103 are mounted as in a standard roll press and are used to provide the compressive force on the web 104 and felt 105. The lower roll 103 can be replaced by a shoe press.

The air knives 107 are used to direct a flow or gas at the line where the web 104 and heated roll 101 contact cease and at the line where the felt 105 and the roll 103 contact cease. The gas flow through the air knives 107 is of sufficient flow rate and of the appropriate direction to produce a high pressure region at the roll nip opening which provides an equivalent pressure chamber. The air knives 107 are of sufficient number to produce a uniform high pressure region across the entire face of the heated roll 101 and the lower roll 103. The gas used in the air knives 107 can be air or any other gas which does not react with the web 104, felt 105 or apparatus, or create a hazard for the personnel operating the apparatus. A gas cooled below ambient temperatures may be used. Use of a cooled gas may reduce the pressure required to inhibit delamination of the web 104.

Further, the flow of gas may be out of the region the nip can effectively cool. The side covers 106 serve to limit the flow of gas across the face of the rolls, web 104 and felt 105 but can be adjusted to allow sufficient flow to cool. The air knives 106 directing the gas flow towards the felt 105 can be replaced by a rigid platform which would be positioned directly underneath the felt 105 and would support both the felt 105 and the web 104. A pressure probe can be inserted into the region immediately adjacent to the nip opening for the purpose of measuring the pressure generated by the gas flow from the air knives 107.

The rotation direction of the heated roll 101 and the lower roll 103 are indicated by arrows in FIG. 7. The roll rotation serves to propel the felt 105 and the web 104 between the two rolls. The heated roll can be constructed of steel, steel coated with a low thermal diffusivity material such as ceramic, or from any other material with the required strength properties. The thermal characteristics of the heated roll may affect the gas pressure required to inhibit delamination.

EXAMPLE 5

Figure 10:
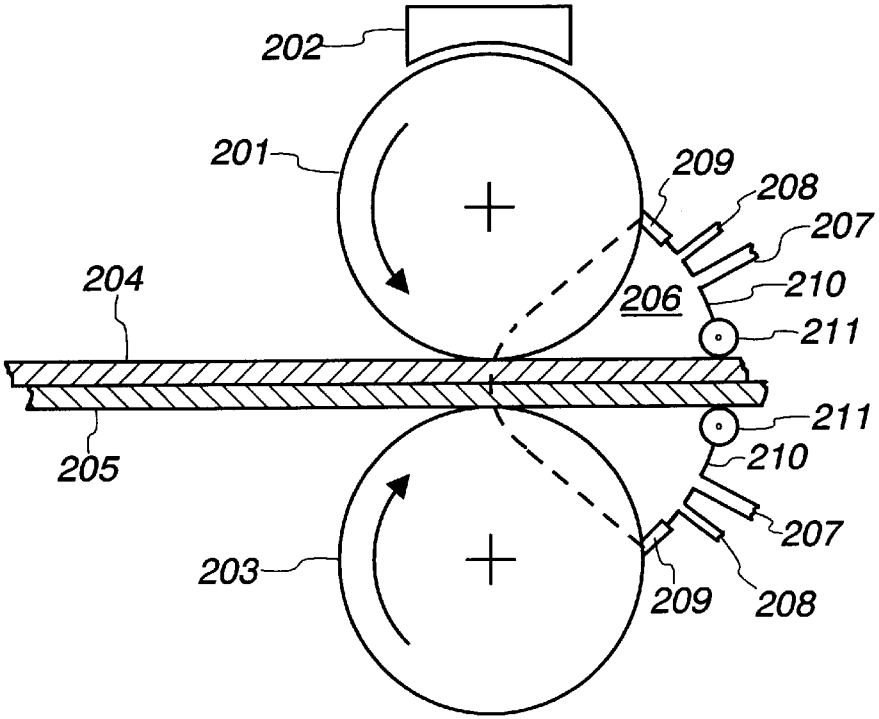
FIG. 10 is a schematic side view of the apparatus shown in FIG. 8 taken along line 10—10.
Figure 9:
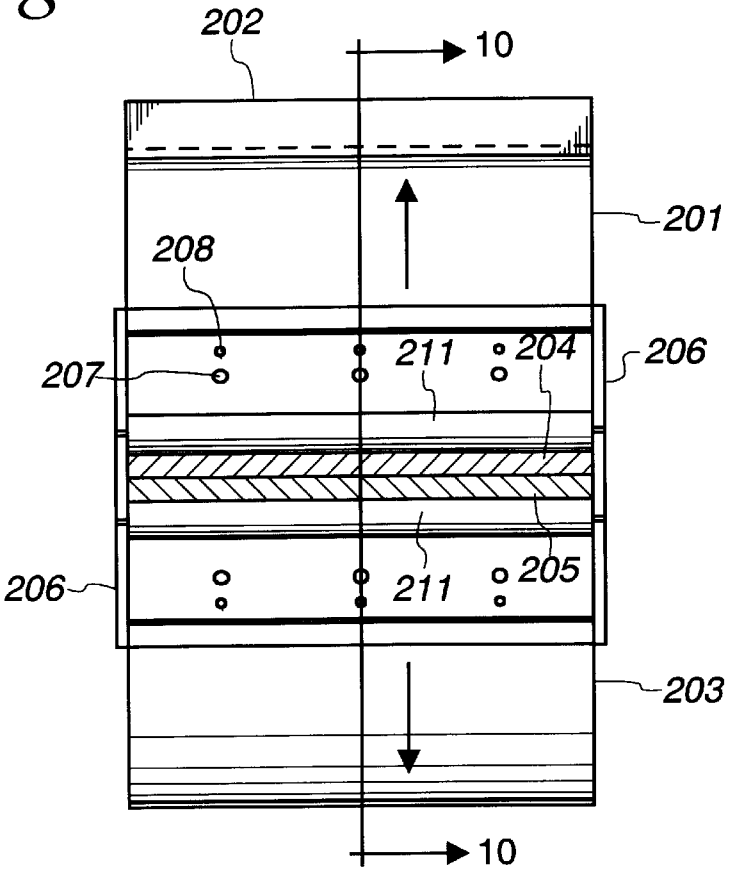
FIG. 9 is a schematic end view of another industrial implementation of the invention.

The method of the present invention can be implemented on an industrial scale as shown in FIGS. 9 and 10. The apparatus in FIGS. 9 and 10 is a roll press. It includes a heated roll 201, a heater 202, a lower unheated roll 203, the web 204 being pressed, a felt 205 for transporting the web 204, a pair of side covers 206 and a number of gas inlets 207, a number of gas exhausts 208, a chamber cover 210, flexible seals 209 and rollers 211. The flexible seals provide a gas seal between the chamber cover 210 and the heated roll 201 and between the chamber cover 210 and the lower roll 203. The rollers 211 provide a gas seal between the chamber cover 210 and the web 204 and between the chamber cover 210 and the felt 205. The heated roll 201 and the lower roll 203 are mounted as in a standard roll press and are used to provide the compressive force on the web 204 and felt 205. The lower roll 203 can be replaced by a shoe press. The gas inlets 207 are used to introduce gas into the chamber formed by the chamber cover 210, the heated roll 201, the lower roll 203 and the side covers 206. Introducing gas into the chamber causes the chamber to pressurize and thus inhibit delamination of the web.

The gas exhausts 208 can be used to depressurize the chamber and to control the pressure level inside the chamber as well as gas flow through the chamber. The gas inlets 207 can also be used to control the chamber pressure. The gas flow introduced through the gas inlets 207 needs to be of a direction and volume flow rate that does not damage the web 204 yet produces the desired pressure within the chamber. If the required volume flow rate is high enough that the web 204 may be damaged then a baffle (not shown) should be introduced between the gas inlet 207 and the web 204.

The gas used to pressurize the chamber can be air or any other gas which does not react with the web 204, felt 205 or apparatus or create a hazard for the personnel operating the apparatus. A gas cooled below ambient temperatures may be used. Use of a cooled gas may reduce the pressure required to inhibit delamination of the web 204. The chamber portion beneath the felt 205 can be replaced by a rigid platform (not shown) which would be positioned directly beneath the felt 205, and would support both the felt 205 and the web 204. A second chamber cover 210 can be added downstream from the first chamber cover 210. In this arrangement, the region covered by the first chamber cover 210 would be at a pressure P1 and the region between the second chamber cover 210 and the first chamber cover 210 would be at pressure P2, where P1>P2. A pressure probe is inserted into each chamber for the purpose of measuring the pressure within the chamber.

The rotation direction of the heated roll 201 and the lower roll 203 are indicated by arrows in FIG. 10. The roll rotation serves to propel the felt 205 and the web 204 between the two rolls. The heated roll may be constructed of steel, steel coated with a low thermal diffusivity material such as ceramic, or from any other material with the required strength properties. The thermal characteristics of the heated roll may affect the gas pressure required to inhibit delamination.

EXAMPLE 6

Figure 12:
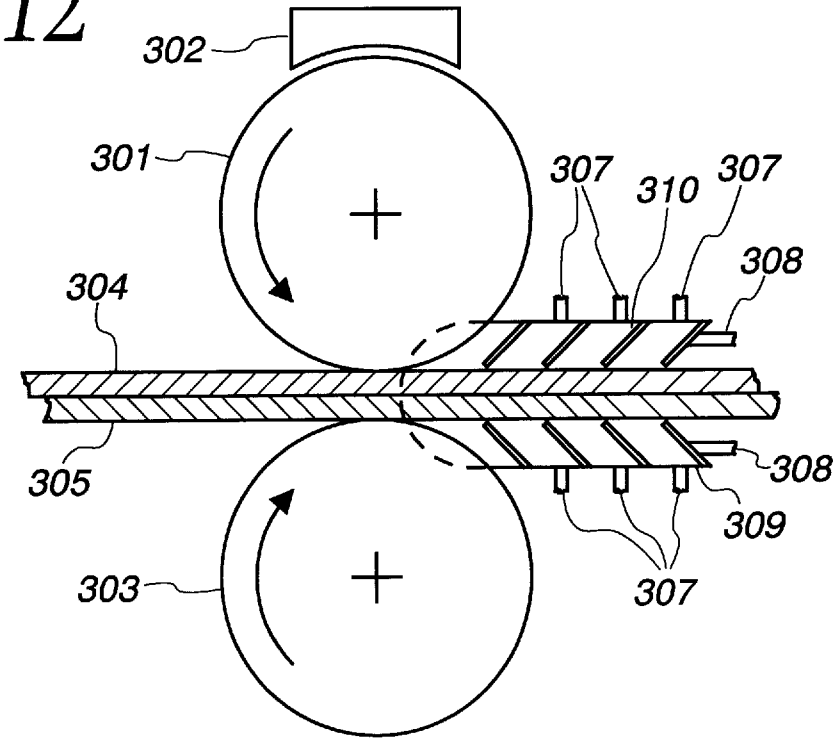
FIG. 12 is a schematic end view of the apparatus shown in FIG. 10 taken along line 12—12.
Figure 11:
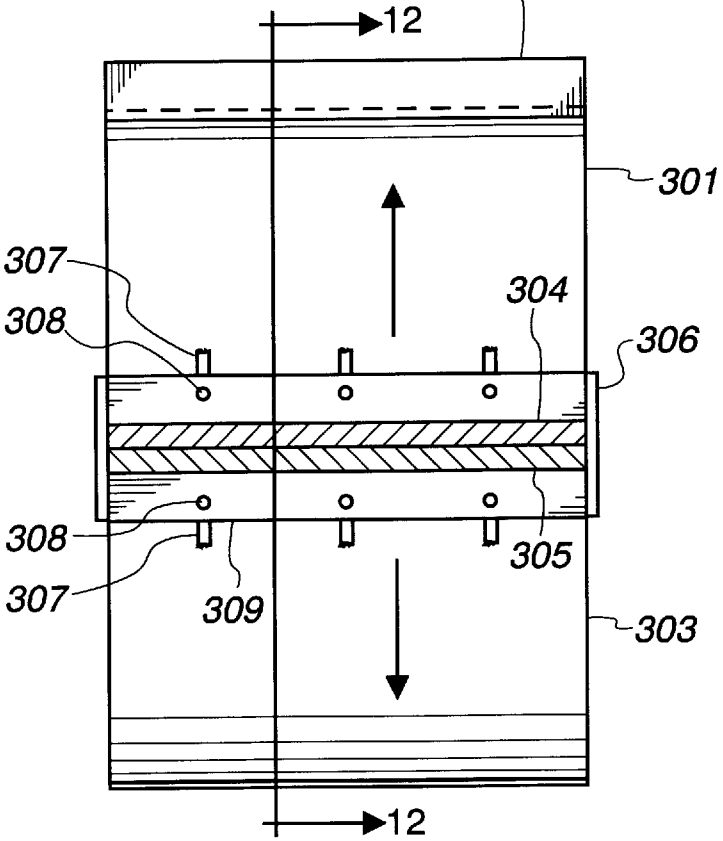
FIG. 11 is a schematic side view of a further industrial implementation of the invention.

The method of the present invention can be implemented on an industrial scale as shown in FIGS. 11 and 12. The apparatus in FIGS. 11 and 12 is a roll press. It includes a heated roll 301, a heater 302, a lower unheated roll 303, the web 304 being pressed, a felt 305 for transporting the web 304, a pair of side covers 306, a number of gas inlets 307, a number of gas exhausts 308 and a foil assembly 309. The heated roll 301 and the lower roll 303 are mounted as in a standard roll press and are used to provide the compressive force on the web 304 and felt 305. The lower roll 303 can be replaced by a shoe press. The foil assembly 309 consists of multiple foils 310 which create small closed chambers between successive foils 310 and the web 304 or the felt 305. The sides of the foil assembly 309 are sealed by side covers 306.

The chamber formed by the foils 310 which is closest to the heated roll 301 and the chamber formed by the foils 310 which is closest to the lower roll 303 are at the highest pressure. Moving downstream from the rolls, the pressure in each succeeding chamber is less than that in the preceding chamber. In this way, the web 304 is subjected to a series of pressure steps which decrease the pressure as the web moves away from the rolls. The gas inlets 307 are used to introduce gas into each chamber formed by the foils 310 and the web 304 or felt 305. Introducing gas into the chambers causes the chamber to pressurize and thus inhibit delamination of the web.

The gas exhaust 308 can be used to depressurize the chamber and to control the pressure level inside the chamber. The gas will tend to flow from the high pressure chambers to the low pressure chambers and out of the gas exhaust 308. The gas inlets 307 can also be used to control the chamber pressure. The gas flow introduced through the gas inlets 307 needs to be of a direction and volume flow rate that does not damage the web 304 yet produces the desired pressure within the chamber. If the required volume flow rate is high enough that the web 304 may be damaged then a baffle should be introduced between the gas inlet 307 and the web 304. The gas used to pressurize the chamber can be air or any other gas which does not react with the web 304 or felt 305, or apparatus or create a hazard for the personnel operating the apparatus. A gas cooled below ambient temperatures may be used. Use of a cooled gas may reduce the pressure required to inhibit delamination of the web 304. The chamber portion beneath the felt 305 can be replaced by a rigid platform (not shown) which would be positioned directly beneath the felt 305, and would support both the felt 305 and the web 304. A pressure probe (not shown) should be inserted into each of the chambers formed by the foils 310.

The rotation direction of the heated roll 301 and the lower roll 303 are indicated by arrows in FIG. 12. The roll rotation services to propel the felt 305 and the web 304 between the two rolls. The heated roll may be constructed of steel, steel coated with a low thermal diffusivity material such as ceramic, or from any other material with the required strength properties. The thermal characteristics of the heated roll will affect the gas pressure required to inhibit delamination.

EXAMPLE 7

Figure 13:
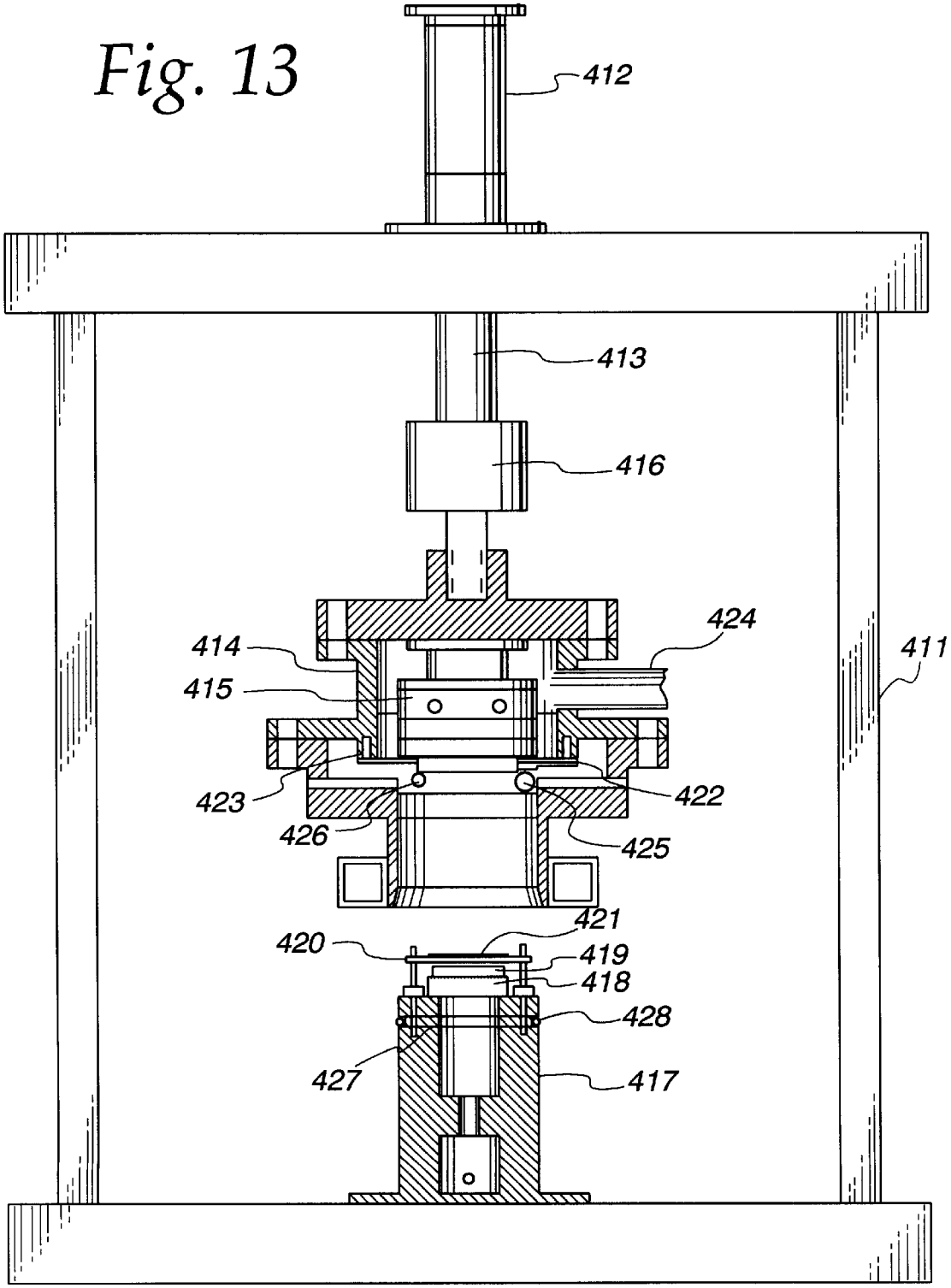
FIG. 13 is a schematic side view of an electrohydraulic press, pressure cylinder and pressure piston that is designed to perform heated press surface pressing at elevated pressures.

Laboratory scale pressing simulations were carried out using the apparatus shown in FIG. 13. The apparatus includes a frame 411 on which is mounted a hydraulic cylinder 412. The piston of the hydraulic cylinder 413 actuates a pressure cylinder 414 and heated head 415 through a load cell 416. A heated platen 422 is mounted at the lower extremity of the heating head 415. A thermocouple 423 is mounted between the heating head and the heated platen to measure the temperature of the platen. A pressure piston 417 supports a platen 418 on which rests a felt 419. The pressure piston also supports a ring 420 on which rests a sheet 421 which is to be pressed. A gas inlet 424 is mounted on the upper portion of the pressure cylinder 414. A gas exhaust 425 is mounted on the lower portion of the pressure cylinder.

A pressure transducer 426 is located on the lower portion of the pressure cylinder. The pressure piston 417 has a gasket groove 427 and a gasket 428 which provides a dynamic seal when the pressure cylinder 423 and heated platen 422 are moved toward the lower platen 418 to initiate the pressing of the sheet 421. The pressure cylinder 414 and pressure piston 417 have dimensions which insure that a dynamic seal is created before the heated platen 422 contacts the raised ring 420 and sheet 421 assembly. The movement of the pressure cylinder 414, the introduction of gas through the gas inlet 424 and the exhaust of gas through the gas exhaust 425 are controlled by a computer. Gas introduced through the gas inlet 424 is supplied from a tank (not shown). The gas pressure in the tank is equal to the gas pressure required to inhibit delamination of the sheet being pressed.

In operation, a felt 419 is placed on the lower platen 418 and a paper sheet 421 is placed on the raised ring 420.

Initially, the gas inlet 424 is closed to inhibit gas from flowing into the pressure cylinder 414 and the gas exhaust 425 is open allowing the interior of the pressure cylinder 414 to vent to the atmosphere. The downward motion of the pressure cylinder 414 is caused by the hydraulic cylinder 412. Prior to the heated platen 422 contacting the raised ring 420 and sheet 421, the gasket 428 creates a dynamic seal between the pressure cylinder 414 and the pressure piston 417, forming a completely closed chamber and allowing the chamber to be pressurized.

As the downward motion of the pressure cylinder 414 continues, the pins on the ring 420 contacting the heating head 415 and the ring 420 is pushed downward until the sheet 421 is in contact with the felt 419. Immediately following this contact, the heated platen 422 contacts the sheet 421 and both the sheet 421 and the felt 419 are pressed between the heated upper platen 422 and the lower platen 418. While the pressing is in progress the gas exhaust 425 is closed and the gas inlet 424 is opened, pressurizing the chamber.

At the completion of the platen pressing which effects impulse drying, the pressure cylinder 414 is moved upward to an intermediate position. In this position, there is sufficient space for the ring 420 and sheet 421 to return to the original position, separating the sheet 421 from the felt 419. The intermediate position is such that the gasket 428 still forms a seal between the pressure cylinder 414 and the pressure piston 417 and the integrity of the chamber formed by the pressure cylinder 414 and the pressure piston 417 is not affected. This position is maintained for a short period of time, normally less than 2 seconds and preferably less than 10 ms. At the end of that time, the gas exhaust 425 is opened and the gas inlet 424 is closed, venting the chamber to atmosphere. In the process of venting, the expelling gas cools the sheet by forced convection. The pressure cylinder 414 is then raised to the original position allowing the sheet 421 and the felt 419 to be removed.

Paper hand sheets having 65% moisture, specific surface of 25 $m^2/g$, Canadian Standard Freeness (CSF) of 400 ml, and a basis weight of 204 $g/m^2$ (42 $lb/1000\ ft^2$) were prepared and a series of pressing tests were conducted where the device in FIG. 13 was used to impulse dry the sheets at platen temperatures of 120° C., 130° C., 140° C., 150° C., 175° C., 200° C., 260° C. and 330° C. The pressing residence time was 60 ms and the maximum platen pressure was about 4.24 MPa. At upper platen temperatures of 120° C. and 130° C. and at atmospheric gas pressure there was no delamination of the sheet. At platen temperatures of 140° C. and above there was delamination of the sheet ranging from isolated areas to the complete sheet splitting. At each of the temperatures above 130° C., tests were conducted with increased gas pressures inside the chamber formed by the pressure cylinder 414 and the pressure piston 417. The pressures were increased until the delamination of the sheets was inhibited.

Various aspects of the invention have been described with particularity; however, numerous variations and modifications will be readily apparent to one skilled in the art.

What is claimed is:

1. Apparatus for drying a fiber web comprising, in combination, pressing means for said web, including a heated roll and another roll or shoe, together forming a nip through which the web passes, the apparatus further comprising web wrapping means for wrapping the web exiting the nip between the rollers, about the heated roll, so as to continuously decrease pressure on the web and so as to prolong the continuously decreasing pressure on the web for a time period at least between one to two times as great as the time period during which the web is pressed in the nip between the rolls, so as to prevent delamination of the dried web.

2. Apparatus for drying a fiber web comprising, in combination, pressing means for said web, a gas pressure chamber adjacent said pressing means, means for introducing pressurized gas into said pressure chamber, means for controlling gas pressure in said gas pressure chamber so as to continuously decrease pressure on the web and so as to prolong the continuously decreasing pressure on the web for a time period at least between one to two times as great as the time period during which the web is pressed in a nip formed between the rolls, and means for venting gas from said gas pressure chamber, so as to prevent delamination of the dried web.

3. Apparatus for drying a fiber web in accordance with claim 2 wherein said pressing means includes a roller for contacting the web.

4. Apparatus for drying a fiber web in accordance with claim 2 wherein said pressing means is a shoe press.

5. Apparatus for drying a fiber web in accordance with claim 2 wherein said means for introducing pressurized gas comprises a plurality of air knives.

6. Apparatus for drying a fiber web in accordance with claim 2 wherein said gas pressure chamber encloses said pressing means.

* * * * *

UNITED STATES PATENT AND TRADEMARK OFFICE

CERTIFICATE OF CORRECTION

PATENT NO. : 5,839,203
DATED : November 24, 1998
INVENTOR(S) : David I. Orloff et al.

It is certified that error appears in the above-identified patent and that said Letters Patent is hereby corrected as shown below:

Column 1,
Line 10, above the caption "Background of the Invention" insert the following:

-- Governmental Rights

This invention was made with Government support under Contract No. DE-FG02-85CE40738 awarded by the Department of Energy. The government has certain rights in this invention. --

Signed and Sealed this

Twenty-fifth Day of December, 2001

*Attest:*

*Attesting Officer*

JAMES E. ROGAN
*Director of the United States Patent and Trademark Office*